United States Patent [19]

Dale et al.

[11] 4,212,430

[45] Jul. 15, 1980

[54] HAND-HELD PULVERIZER

[75] Inventors: John D. Dale; David G. Knotter, both of Phoenix, Ariz.

[73] Assignee: Deering Precision Instruments Co., Phoenix, Ariz.

[21] Appl. No.: 940,956

[22] Filed: Sep. 11, 1978

[51] Int. Cl.[2] ..... B02C 7/00

[52] U.S. Cl. ..... 241/89.4; 241/100; 241/169.1; 241/169.2; 241/258

[58] Field of Search ..... 241/278 R, 258, 257 R, 241/274, 169.1, 169.2, 100, 168, 89.4; 17/67

[56] References Cited

U.S. PATENT DOCUMENTS

| | | | |
|---|---|---|---|
| 48,156 | 6/1865 | Colby | 241/86 |
| 605,175 | 6/1898 | Buchtel | 209/358 |
| 731,986 | 6/1903 | Warren | 241/168 X |
| 795,746 | 7/1905 | Wingfield et al. | 241/168 X |
| 926,327 | 6/1909 | Hoffman | 241/258 |
| 936,101 | 10/1909 | Edwards, Jr. | 241/169.1 |
| 2,137,366 | 11/1938 | Sundstrand | 241/100 X |
| 2,726,816 | 12/1955 | Brantley | 241/169.2 |
| 2,858,081 | 10/1958 | Sinkinson | 241/169.2 |
| 3,581,790 | 6/1971 | Del Conte | 241/169.1 X |
| 3,633,834 | 1/1972 | Nissen | 241/169.1 |

FOREIGN PATENT DOCUMENTS

| | | | |
|---|---|---|---|
| 1025116 | 2/1958 | Fed. Rep. of Germany | 241/169.1 |

*Primary Examiner*—Mark Rosenbaum
*Attorney, Agent, or Firm*—Laff, Whitesel & Rockman

[57] ABSTRACT

A hand-held pulverizer which is compact and efficient to use is provided to pulverize or grind a material. A cover is removably attached to a hollow cylindrical casing containing a mesh screen. A grinder disc is securely affixed to one end of a shaft rotatably mounted in the cover and is in frictional contact with the mesh screen. A handle attached to the shaft above the cover permits the shaft and disc to be rotated, grinding or pulverizing the material placed on the screen beneath the disc. A collecting plate attached to the bottom of the cylindrical casing receives the pulverized material falling through the screen.

13 Claims, 5 Drawing Figures

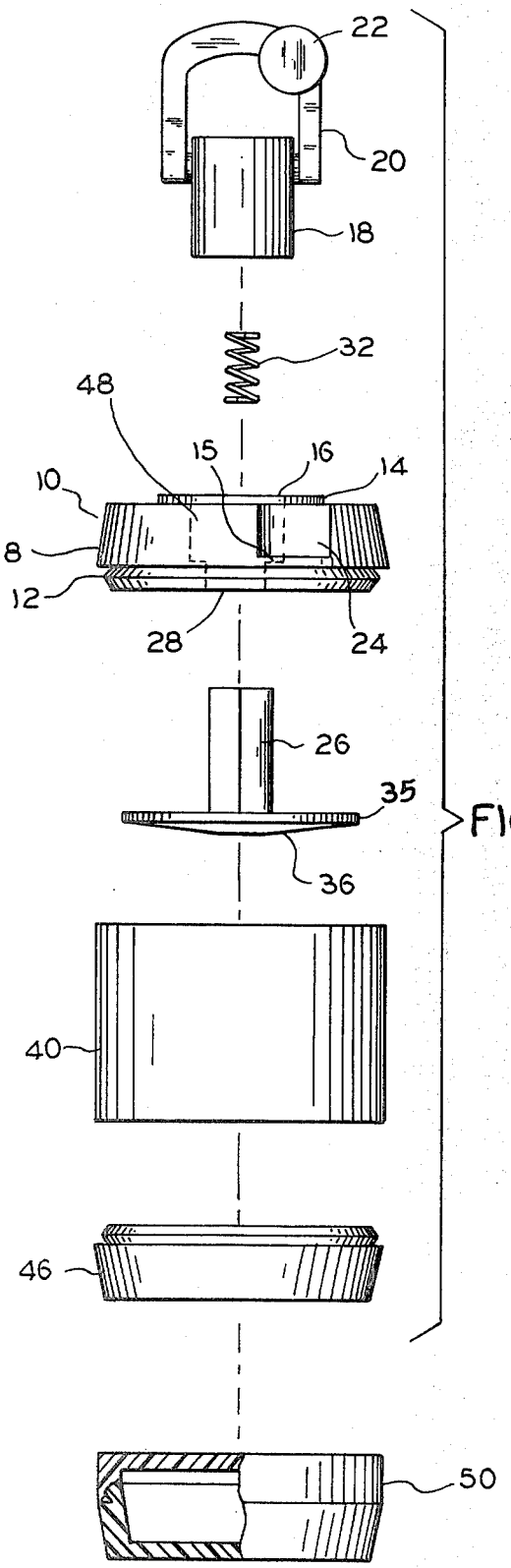
FIG. 1
FIG. 5
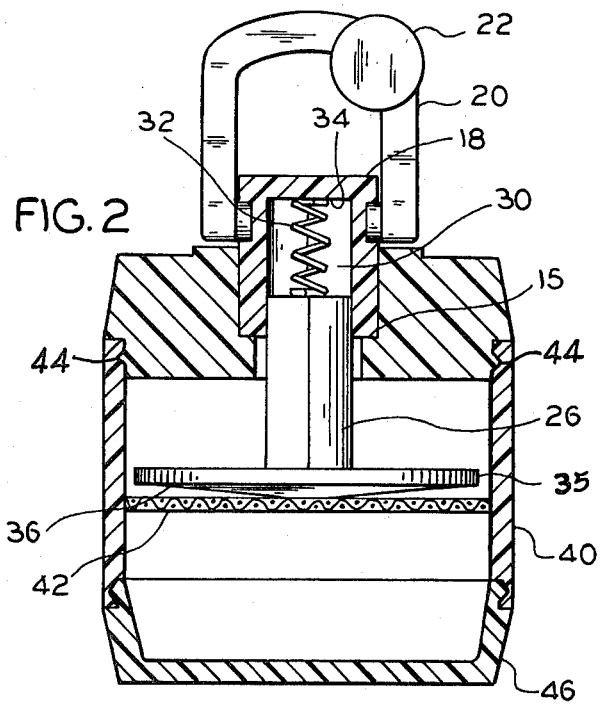
FIG. 2
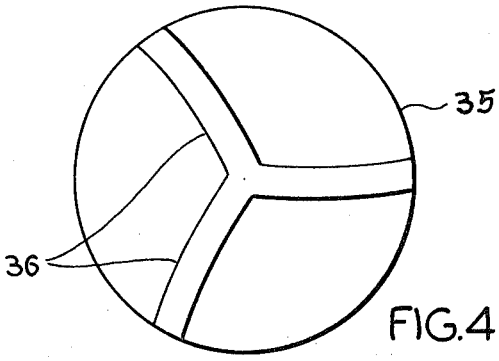
FIG. 4
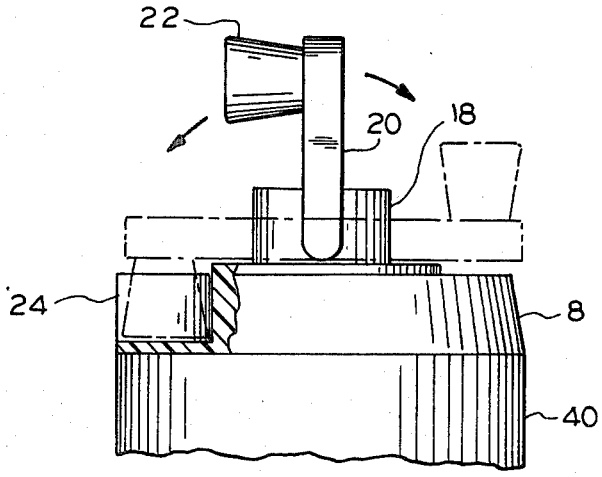
FIG. 3

HAND-HELD PULVERIZER

BACKGROUND OF THE INVENTION

This invention relates to a pulverizer and more particularly, to a hand-held pulverizer that is compact.

Present day grinders and pulverizers are generally cumbersome and inconvenient to carry about. Further, these devices do not provide an efficient and convenient method to store the pulverized material. Another disadvantage of the present grinders is that it is often difficult to regulate the degree of pulverization. Thus, there is a need for a simple, compact pulverizer.

Accordingly, a primary object of the present invention is to provide a new and improved pulverizer which is compact and convenient to carry about.

Another object of my invention is to provide a novel pulverizer which provides an efficient and convenient method to store the pulverized material.

Yet another object of my invention is to provide a compact pulverizer in which the degree of pulverization can be easily regulated.

Still another object of my invention is to provide a compact pulverizer which is hand held when operated.

An additional object of my invention is to provide a pulverizer including a bias means for urging the pulverizing element against the screen through which the material is pulverized.

A further object of my invention is to provide a simple, compact pulverizer which may be used quickly and efficiently.

BRIEF DESCRIPTION OF THE DRAWINGS

FIG. 1 is an exploded side elevation view of the disclosed invention;

FIG. 2 is a cross-sectional side elevation view of the disclosed invention;

FIG. 3 is a partial side elevation view of the top portion of the disclosed invention;

FIG. 4 is a plan view of the grinder disc forming part of the disclosed invention; and FIG. 5 is a detail view of an auxiliary cap used forming part of the invention.

DETAILED DESCRIPTION OF THE INVENTION

As shown in FIGS. 1 and 2, a pulverizer constructed in accordance with our invention comprises a molded cap 10 having an upper portion 8 and threaded section 12 of reduced diameter extending below portion 8. The top of cap 10 includes a raised circular boss member 14. Cavity 48 communicates between aperture 16 located in boss member 14 and aperture 28 located in threaded section 12. The upper part of cavity 48 has a larger diameter than the lower part, forming a shelf 15 in cap 10.

A cylindrical post 18 is rotatably mounted in cavity 48 and extends upward through aperture 16 while seated on shelf 15. Ring 20 is pivotally attached to post 18 and includes a knob 22 fixed to one corner of ring 18. Portion 8 of cap 10 includes a recessed portion 24 to receive knob 22 when the device is not in use and ring 22 is pivoted downward to lie flat on top of cap 10. When operational, ring 20 is pivoted 180° so that the knob 22 faces upward, and is used as a finger-operated crank to rotate post 18 (FIG. 3).

As shown in FIG. 2, post 18 includes a polyangular shaped chamber 30, such as square, triangular or rectangular shaped. Rectangular, square, or triangularly shaped shaft 26 extends through aperture 28, located in section 12 of cap 10, and into chamber 30 of post 18. Since chamber 30 is shaped to mate with shaft 26, rotation of post 18 by knob 22 and ring 20 will also rotate shaft 26. Shaft 26 is mounted for limited vertical movement in chamber 30, with resilient element 32, located in cavity 30 between abutment surface 34 of post 18 and shaft 26, exerting a downward resilient force on shaft 26.

Circular disc 35 is fixed to the bottom of shaft 26 and includes a plurality of spiral-shaped grinder or pulverizer blades 36 molded onto the underside of disc 35. Blades 36 are designed to move the material to be ground towards the center of disc 35 as it is rotated.

Mesh screen 42, preferably made of nylon or some suitable material, extends across a central portion of cylinder member 40. Cylinder member 40 is threaded, as at 44, allowing the cylinder member to be securely attached to section 12 of cap 10. When cylinder 40 and cap 10 are assembled as shown in FIG. 2, screen 42 and disc 35 come into contact. The upward force exerted against disc 35 by screen 42 is opposed by the downward resilient force of element 32, thereby maintaining blades 36 in pressure contact with screen 42.

Bowl-shaped collecting plate 46 is removably held to the bottom portion of cylinder 40 by means of threads 47 to receive the pulverized material falling through screen 42. Auxiliary top 50 (FIG. 5) is adapted to be threaded to collector plate 46 when the collector plate is detached from cylinder 40 to form a pocket sized storage container for the pulverized material.

To operate our unique hand-held pulverizer, cap 10 is first unthreaded from cylinder 40 and the material to be pulverized, such as medicinal material in pill form, is placed on screen 42. Cap 10 is then threaded back onto cylinder 40, whereby disc 35 bears against screen 42 and the material disposed on the screen under the bias of resilient element 32. Ring 20 is rotated 180° as shown by the arrows in FIG. 3, removing knob 22 from recess 24, and placing knob 22 in a position facing upward. Knob 22 is then grasped to rotate post 18, shaft 26 and disc 35, while cylinder 40 is held stationary from the bottom. As disc 35 rotates, blades 36 pulverize the material placed on screen 42 until the material falls through the screen and into collecting plate 46. Blades 36 are curved or sloped in a spiral shape to drive the material on screen 42 towards the center of the screen, where the pulverizing action is most efficient.

After the material has been pulverized and collected in plate 46, the plate may be unthreaded from cylinder 40 and auxiliary top 50 may then be threaded to collecting plate 46 to form a compact container for the pulverized material.

Interchangeable cylinders 40 are provided with screens 42 of different mesh, permitting easy regulation of the degree of pulverization.

While the principles of our invention have been described above in connection with a specific embodiment and application, it is to be understood that this description is made only by way of example and not as a limitation on the scope of the appended claims.

We claim:

1. A hand-held pulverizer comprising: a hollow cylindrical casing, having openings at opposite ends having; a mesh screen disposed within said cylindrical casing; cover means removably secured to one end of said cylindrical casing; said cover means having a pair of aperture means forming openings on opposite sides of said cover means and a cavity communicating therebetween; rotatable means mounted in said cavity and extending above and below said cover means; handle means disposed on said rotatable means above said cover means to rotate said rotatable means; a pulverizing disc disposed on the end of said rotatable means below said cover means and opposite said handle means having a plurality of spiral-shaped blades disposed on the underside of said pulverizing disc in frictional contact with said mesh screen, whereby material placed on said screen will be driven towards the center of said screen as it is pulverized by said pulverizing disc when said rotatable means is rotated; and a collecting plate removably attached to said cylindrical casing opposite said cover means to receive the pulverized material falling through said mesh screen.

2. The hand-held pulverizer of claim 1, wherein said cover means includes a lower section of reduced diameter having threading means around its circumference, and said cylindrical casing has threading means around its inner circumference to mate with and receive said cover means.

3. The hand-held pulverizer of claim 1 wherein said rotatable means comprises a cylindrical post member disposed in said cavity within said cover means and extending above said cover means, said handle means disposed on said post member above said cover means; said post member having a polyangular shaped chamber therein and an opening in its bottom surface communicating with said chamber; said post member including an abutment surface within said chamber opposite said opening; and a polyangular shaped shaft disposed within said polyangular chamber of said post member and extending below said cover means into said cylindrical casing, said shaft having a planar upper surface and said pulverizing disc disposed opposite said upper surface on the end of said shaft extending below said cover means.

4. The hand-held pulverizer of claim 3 including a resilient element disposed between said abutment surface of said post member and the upper surface of said shaft whereby said resilient element biases said pulverizing disc against said mesh screen.

5. The hand-held pulverizer of claim 4 wherein said resilient element is a spring.

6. The hand-held pulverizer of claim 1 or 3 wherein said handle means includes a ring member pivotally mounted on said rotatable means above said cover means; knob means disposed on said ring, whereby said knob may be gripped and used to rotate said ring and said rotatable means when said ring is pivoted in one direction; and a recess formed in said cover means to receive said knob means when said ring is pivoted in an opposite direction.

7. The hand-held pulverizer of claim 1 including a second cover means to cover said collecting plate after said collecting plate has received said pulverized material and said collecting plate has been detached from said cylindrical casing to form a compact storage container for said material.

8. The hand-held pulverizer of claim 1 including a plurality of interchangeable cylindrical casings having screens of different mesh to regulate the degree of pulverization.

9. A hand-held pulverizer comprising: a hollow cylindrical casing having sidewalls and openings at opposite ends of said casing; a pliable nylon mesh screen disposed within said cylindrical casing; cover means removably secured to one end of said cylindrical casing; said cover means having a pair of aperture means forming openings on opposite sides of said cover means and a cavity communicating therebetween; rotatable means mounted in said cavity and extending above and below said cover means; said rotatable means comprising a cylindrical post member disposed in said cavity within said cover means and extending above said cover means; said post member having a polyangular shaped chamber therein and an opening in its bottom surface communicating with said chamber; said post member including an abutment surface within said chamber opposite said opening; and a polyangular shaped shaft disposed within said polyangular chamber of said post member and extending below said cover means into said cylindrical casing, said shaft having a planar upper surface; handle means disposed on said post member above said cover means to rotate said rotatable means; a pulverizing disc disposed on the end of said shaft extending below said cover means having a plurality of spiral shaped blades disposed on the underside of said pulverizing disc; a resilient element disposed between said abutment surface of said post member and said planar upper surface of said shaft, whereby said resilient element biases said pulverizing disc against said pliable nylon mesh screen, said blades slightly deflecting said pliable mesh screen as said disc is rotated insuring that material placed on said mesh screen is thoroughly pulverized when said disc is rotated; and a collecting plate removably attached to said cylindrical casing opposite said cover means to receive the pulverized material falling through said mesh screen.

10. The hand-held pulverizer of claim 9 wherein said cover means includes a lower section of reduced diameter having threading means around its circumference, and said cylindrical casing has threading means around its inner circumference to mate with and receive said cover means.

11. The hand-held pulverizer of claim 9 wherein said handle means includes a ring member pivotally mounted on said rotatable means above said cover means; knob means disposed on said ring, whereby said knob may be gripped and used to rotate said ring and said rotatable means when said ring is pivoted in one direction; and a recess formed in said cover means to receive said knob means when said ring is pivoted in an opposite direction.

12. The hand-held pulverizer of claim 9 including a second cover means to cover said collecting plate after said collecting plate has received said pulverized material and said collecting plate has been detached from said cylindrical casing to form a compact storage container for said material.

13. The hand-held pulverizer of claim 9 including a plurality of interchangeable cylindrical casings having nylon screens of different mesh to regulate the degree of pulverization.

* * * * *

UNITED STATES PATENT AND TRADEMARK OFFICE

CERTIFICATE OF CORRECTION

PATENT NO. : 4,212,430

DATED : July 15, 1980

INVENTOR(S) : John D. Dale, David G. Knotter

It is certified that error appears in the above-identified patent and that said Letters Patent are hereby corrected as shown below:

Column 2, Line 66, after the word "ends", the word "having" should be deleted.

Signed and Sealed this

*Fourth* Day of *November 1980*

[SEAL]

*Attest:*

SIDNEY A. DIAMOND

*Attesting Officer*

*Commissioner of Patents and Trademarks*